United States Patent [19]

Grayson

[11] Patent Number: 5,025,747

[45] Date of Patent: Jun. 25, 1991

[54] FLOTATION SUPPORTED SUBMERSIBLE SWIM PLATFORM

[76] Inventor: James L. Grayson, 1211 S. Washington Ave., Glendora, Calif. 91740

[21] Appl. No.: 396,230

[22] Filed: Aug. 21, 1989

[51] Int. Cl.[5] ..... B63B 17/00

[52] U.S. Cl. ..... 114/362; 114/343

[58] Field of Search ..... 114/362, 343, 25; 441/80

[56] References Cited

U.S. PATENT DOCUMENTS

| | | | |
|---|---|---|---|
| 3,195,680 | 7/1965 | Thornburg et al. | 114/362 |
| 3,587,123 | 6/1971 | O'Boyle | 114/362 |
| 4,538,314 | 9/1985 | Baranowski | 114/362 |
| 4,823,910 | 4/1989 | Day | 114/362 |

FOREIGN PATENT DOCUMENTS

| | | | |
|---|---|---|---|
| 2752289 | 5/1979 | Fed. Rep. of Germany | 114/362 |
| 2629042 | 9/1989 | France | 114/362 |

*Primary Examiner*—David H. Brown

*Attorney, Agent, or Firm*—John Holtrichter, Jr.

[57] ABSTRACT

A submersible platform functioning as a zone of transition to provide swimmers with a place to rest while allowing them to easily move from a horizontal swimming position to a vertical position necessary for boarding, including a submersible platform pivotally attached to a boat and at its opposite side to a leverage arm, the far end of which is attached to a flotation support. Optionally, the platform may be elongated and attached to the floatation support.

12 Claims, 5 Drawing Sheets

FLOTATION SUPPORTED SUBMERSIBLE SWIM PLATFORM

TECHNICAL FIELD

This invention relates to the field of swim platforms attached to boats and more particularly to such a platform that may be submersed to facilitate boarding of the boat by those in the water.

BACKGROUND ART

The invention is designed to increase the safety and ease of a swimmer in exiting the water to board a boat. The invention includes a platform which is preferably positioned below the level of the water where it functions as a zone of transition to allow a swimmer or diver the ability to move easily from a horizontal swimming body position to a vertical boarding body position. The platform may also provide swimmers and divers with an area to rest and recover their strength and adjust or remove equipment.

In the past, getting on board a boat from the water, in some cases with heavy SCUBA equipment, was clumsy, fatiguing, dangerous, and at times impossible to do without assistance. Heretofore, there have been four basic methods of boarding a boat from the water, namely, (1) without aid; (2) with the aid of a swim step; (3) with the aid of a vertical ladder; and (4) with the aid of an inclined ramp.

The use of muscle power alone to get over the side of a boat is by far the most difficult and dangerous of the abovementioned methods. This method requires a great deal of upper body strength and may not be possible with SCUBA equipment, or when boarding a boat with over 12 inches of freeboard. A fatigued swimmer has no means of resting and regaining his or her strength prior to boarding. The time required by this method of exiting the water may leave swimmers vulnerable to attack by sharks or other marine predators.

Swim steps are usually mounted one foot or more above the water line, and usually extend a maximum of 24 inches beyond the transom. They require balance and upper body strength similar to that required by unaided boarding, and share all of the disadvantages of unaided boarding. An example of such swimming aid structures are described in U.S. Pat. Nos. 3,587,123 and 4,495,883.

Boarding with the use of a ladder offers some improvement over unaided boarding. Ladders may also be used in conjunction with a swim step as shown in U.S. Pat. No. 4,765,438. On the negative side, ladders still require balance and upper body strength. The difficulties are compounded by the inward curve of most boat hulls. The ladder provides a very poor resting area for fatigued swimmers. When a swimmer approaches a ladder, he must take hold of the ladder and move into a vertical body position. He must then remove his swim fins so that he can use the steps of the ladder. This position removes his ability to propel himself or to resist water current. The vertical body position also creates a pressure differential of approximately ½ PSI between the level of the lungs and the surface air pressure. This pressure differential can add significantly to a swimmer or diver's fatigue and anxiety.

Inclined diving ramps are used on commercial SCUBA diving boats. These platforms are usually attached to the transom of the boat at a point one foot or more above the water line. The opposite end of the platform can be lowered to a point one foot or more below the surface of the water and held in place by transom mounted cables. This method of boarding is easy, rapid, safe, and requires very little upper body strength. On the negative side, the inclined ramps are expensive, ungainly, and difficult to mount and maintain. Ramps are unsuited to boats with narrow transoms such as sail boats, small boats, inflatable boats and boats with protrusions such as rudders or stern drives. Few boat owners would wish to permanently spoil the aesthetics of their craft with such ungainly structures.

Examples of such prior art ramps are found in U.S. Pat. No. 4,538,314 showing an inclined ramp with an abbreviated platform utilizing a rigid lever structure, and U.S. Pat. No. 4,723,929 which shows an inflatable ramp that is not capable of submerged deployment. Still another boarding ramp is shown in U.S. Pat. No. 2,914,779 where the swimmer support never goes below the surface of the water. A submersible platform is taught in U.S. Pat. No. 4,773,887. This complicated structure takes the form of an elevator. It is totally supported by the boat, and would require a boat of substantial displacement to support its bulk. A submerged ramp is shown in U.S. Pat. No. 3,891,053, which suffers from similar handicaps to the former device. In general, none of these devices provide an adequate stable area for a swimmer to rest or to remove or adjust bulky equipment. In fact, none of the above referenced prior art patents describe or offer the simple, stable, and advantageous structure of the present invention.

In contradistinction to the prior art, the present invention is an highly functional solution to the problems raised with the traditional boarding methods. The invention is designed to increase the safety and ease of exiting the water to board a boat while providing a safe and convenient resting area. It is capable of attaching to and functioning with the ladder systems. It may also completely replace the ladder on boats with low freeboard such as inflatable boats.

It should thus be clear that the prior art in the subject area of interest generally lacks the utility, helpfulness, simplicity, ruggedness, and safety that is most required in a flotation supported submersible swim platform, and such a platform which obviates the aforementioned shortcomings of the prior art would constitute a significant advancement in the art.

SUMMARY OF THE INVENTION

In view of the foregoing factors and conditions characteristic of the prior art, it is a primary object of the present invention to provide a new and improved flotation supported submersible swim platform Another object of the present invention is to provide a relatively simple yet effective flotation supported swim platform.

Still another object of the present invention is to provide a unique flotation supported submersible swim platform which is capable of attaching to and functioning with existing boat ladders.

Yet another object of the present invention is to provide a flotation supported swim platform that may also replace a boat ladder for use with craft of low freeboard.

Another object of this invention is to provide a means to stabilize a small boat for the purpose of embarkation and recovery of swimmers.

Still another object of this invention is to provide increased utility for small boats or canoes so that relatively unstable craft of narrow beam can be functionally used to recover swimmers and conduct life saving operations.

Still a further object of this invention is to provide a flotation supported submersible swim platform which can be compact for easy storage.

Yet another object of this invention is to provide a flotation supported submersible swim platform that can be adapted to a great variety of waterborne vessels with a minimum of attachment hardware.

Yet a further object of this invention is to provide a significant piece of safety equipment for boat owners that will allow easy boarding from the water by persons with little upper body strength, persons who are fatigued, person who have panicked, and persons suffering from hypothermia.

Still a further object of this invention is to provide an effective and rapidly deployable life saving device which can be used in life saving operations to aid in the recovery of drowning victims and in man overboard recovery, and which may be deployed when used with a stern mounted ladder while underway to greatly speed such recoveries.

In accordance with an embodiment of the present invention, a submersible swim platform is provided to facilitate a swimmer's egress from a body of water onto a structure supporting the platform. The invention includes a platform member having an inner and outer end, pivotal means attached to the inner end of the platform member and to the supporting structure for pivotally supporting the platform member to the supporting structure, and a buoyancy structure spaced from the platform member. The invention also includes an elongated lever member attached at its first end to the platform member and extending outwardly from the outer end of the platform member toward the buoyancy structure, and coupling means attached to the second end of the lever member and to the buoyancy structure for supporting the platform member below the surface of the body of water when the platform member is supporting the weight of a swimmer.

In accordance with the invention, the buoyancy structure may be a solid, cellular, hollow or inflatable float, and the lever member may be affixed to or detachable from the platform member, and may be of fixed or extendable length.

The features of the present invention which are believed to be novel are set forth with particularity in the appended claims. The present invention, both as to its organization and manner of operation and use, together with further objects and advantages thereof, may best be understood by making reference to the following description taken in conjunction with the accompanying drawings in which like reference characters refer to like elements in the several views.

DESCRIPTION OF THE PREFERRED EMBODIMENT

Figure 1:
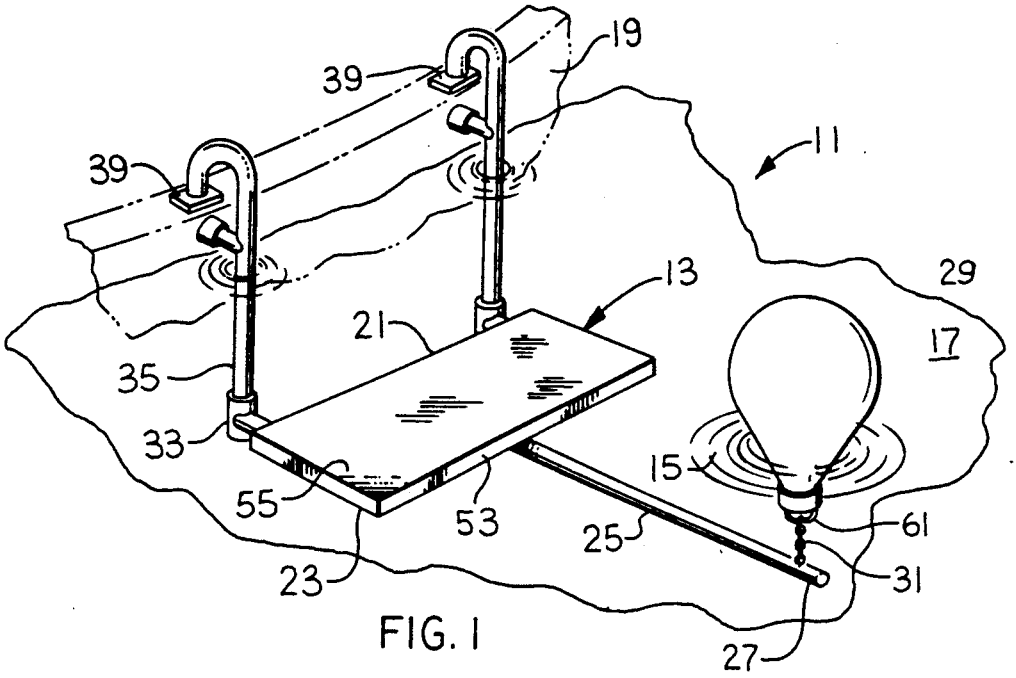
FIG. 1 is a perspective view of the flotation supported submersible swim platform according to a presently preferred embodiment of the invention.
Figure 2:
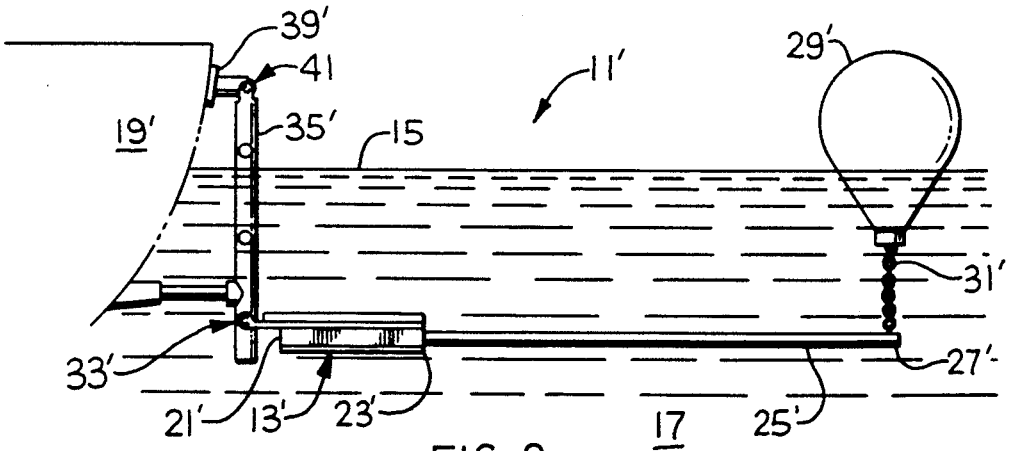
FIG. 2 is a side elevational view of another embodiment of the invention.

Referring now to the drawings and more particularly to FIGS. 1 and 2, there is shown a flotation supported submersible swim platform 11 in accordance with an embodiment of the present invention. The swim platform 11 includes a platform member 13 normally positioned about one foot below the surface 15 of a body of water 17. The platform member 13 utilizes the buoyancy of an accompanying boat 19 to support the side 21 of the member 13 nearest the boat 19. Attached to the opposite side 23 of the member 13 is an elongated leverage arm member 25 which is in turn attached at its outer end 27 to a flotation structure such as float 29 by means of a rope, webbing, chain or direct attachment 31, for example. The leverage arm 25 positions the float 29 at a distance from the platform member 13.

In the embodiment of the invention of FIGS. 1 and 2, the side 21 of the member 13 is supported by means of a pivot assembly 33 (internal pivot pin not shown) mounted on a conventional boat ladder 35 attached to the boat 19 at flanges 39. Also, the boat ladder 35 may include conventionally designed hinges 41 (FIG. 2) that the ladder and its pivotally attached swim platform 11 may trail on the water's surface when the boat is underway and the ladder is mounted to the boat's stern.

The platform member 13 may be constructed from solid materials such as wood or plastic, or it can be configured to allow water to flow therethrough. For example, the member 13 may consist of a generally rectangular frame 53 having a deck portion 55 thereon. The frame may be of any conventional rigid corrosion resistant material, and the deck may be made of rigid forms, such as slats, which will allow water to pass through the grill-like structure with minimal restriction. The deck 55 may also be made of fabric webbing to resemble a mesh trampoline structure suspended within the frame 53. Of course, the frame and deck may be two separate structures or they may be combined into a single integrated form.

The leverage arm member 25 may be of fixed length, such as a plastic dr metal rod or tube, or it can be extensible such as nested tubes. The length of this member may be increased to increase the buoyant force provided by the float 29. Thus, a larger or more buoyant float located a shorter distance from the platform member 13 will be needed to support a particular weight on the member 13 than a smaller or less buoyant float located a greater distance from the platform member. A less practical configuration of the invention would be to use an elongated length platform member to which the flotation member is attached, but the portion of the platform member nearest the float could not support much weight.

The float 29 may be of solid, cellular, or hollow construction and may be an inflatable ball of rubber or rubberized fabric, for example. It can also be fabricated from a polyurethane foam or any other material. It may be desirable to adopt a bright distinctive design for the float to aid in its location and identification by swimmers and other boaters. The shape of float 29 is not critical and can be a ball, cylinder, etc. The float 29 may have one or more attachment points such as ear 61 beneath it where preferably a relatively short length of flexible material such as rope or webbing attaches to float to the far end 27 of the leverage arm member 25. This attachment means is preferably adjustable in length so that the platform member 13 will be maintained at a uniform depth. A conventional buckle arrangement may be utilized for length adjustment, for example.

The pivot support assembly 33 may take several forms. The purpose of this structure is to allow the platform member 13 to pivot and move up and down at the point of attachment to a boat or boat ladder, and the like, while preventing the platform from rotating about its longitudinal axis parallel or coaxial with the longitudinal axis of the leverage arm member 25. The assembly 33 may take the form of an elongated piano hinge, or a series of two or more of spaced smaller hinges, or a pair of conventionally designed pined dowel/slotted sleeve arrangements, as shown.

Preferably, the connection between the invention and the attending boat should be of a quick-release type in order to facilitate the attachment and detachment of the invention to and from the boat. Any conventional scheme may be employed for this purpose. For example, the elongated pin of a hinge could be removable, or a radially extending pin of a hinge could be removable.

Figure 3:
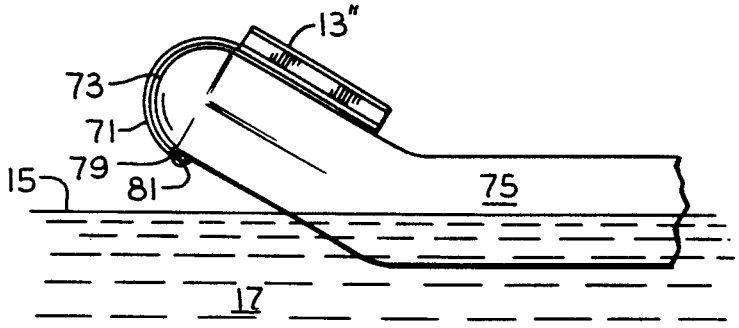
FIG. 3 is an elevational view of an embodiment of the invention wherein it acts as a bow cover.
Figure 4:
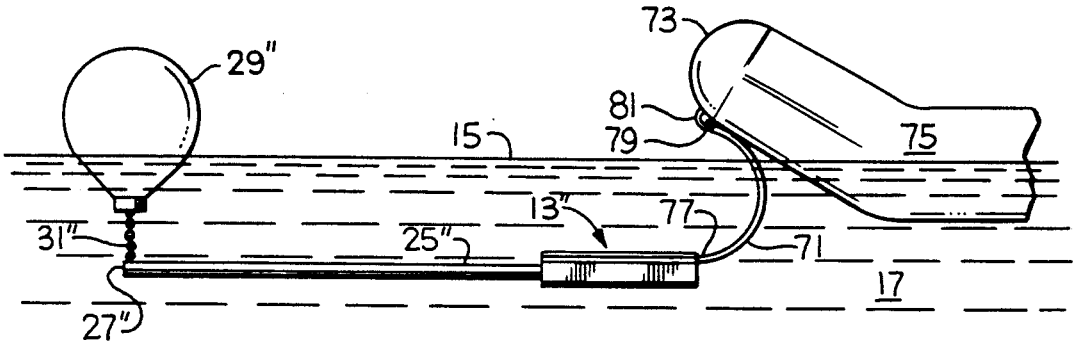
FIG. 4 is a view of the invention rotated to its normal operational position.

Referring now to the embodiment illustrated in FIGS. 3 and 4, the flotation supported submersible swim platform 11 may include a relatively rigid bracket or parallel brackets 71 which has a curved cross section to approximately match the curve of the bow portion 73 of an inflatable boat 75. The bracket or brackets 71 may be integrally attached at its far end 77 to the platform 13, and pivotally attached by conventional snap-shackles 79, for example, to a boat's bow rings (painters) 81. Thus, when the invention is not being used to support a swimmer as shown in FIG. 4, it may be swung upwardly and on top of the boat to act as a bow cover, as in FIG. 3.

Figure 5:
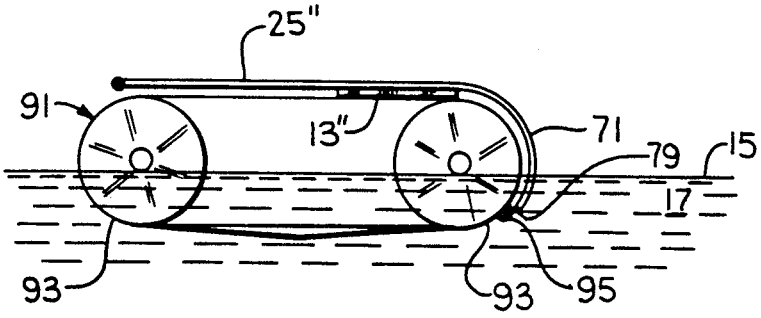
FIGS. 5 and 6 illustrate the use of the embodiment shown in FIGS. 3 and 4 in a manner to act as a boat seat.
Figure 6:
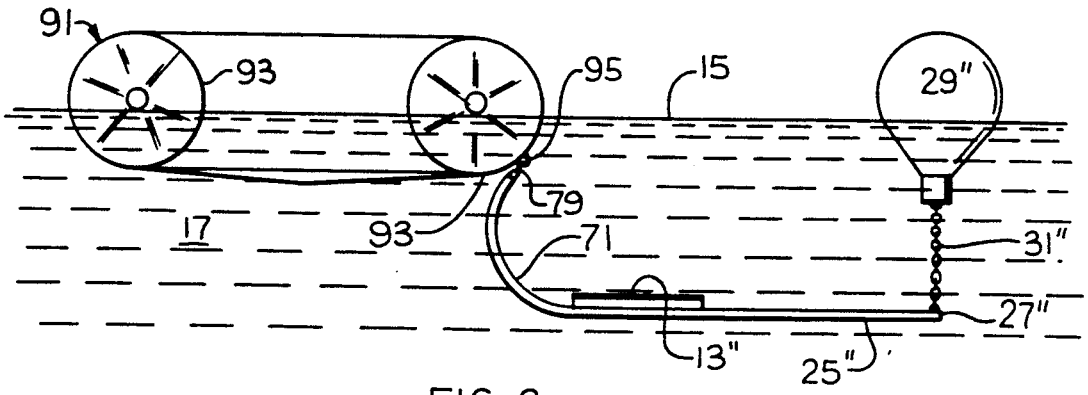

The seat of an inflatable boat 91 having tubular sides 93 may be replaced by the invention, as shown in FIGS. 5 and 6. Here, the curved bracket 71 is pivotally attached to a boat ring 95 extending from a side 93 of the boat 91. In all respects except the attachment point of the invention to an inflatable boat, the structure of the invention is similar to that described with respect to FIGS. 3 and 4. In this embodiment, the support member 13 and the elongated leverage member may be rotated from its normally used position shown in FIG. 6, to act as a boat seat as seen in FIG. 5.

Figure 7:
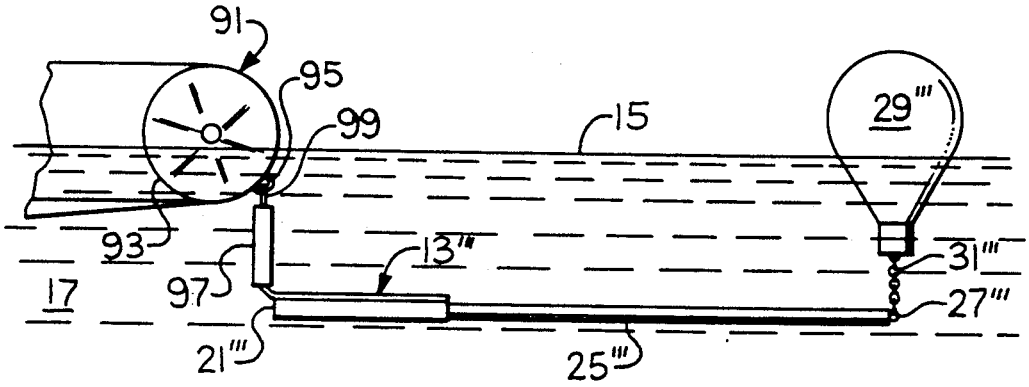
FIG. 7 is an elevational view of yet another embodiment of the invention wherein an L-bracket is utilized.

The pivot assembly of the invention alternately may include an L-shaped bracket 99, as illustrated in FIG. 7. Generally, the L-bracket attaches to the side 21 of the platform member 13 nearest the boat 91, and extends upwardly at a 90 degree angle for a distance of approximately one foot. The top of the L-bracket attaches to the boat at about the water line. The L-bracket 99 is generally used in applications where the invention either replaces a boat ladder or where it attaches to a short ladder which extends to but not substantially beneath the surface of the water. Thus, this bracket maintains an intimate association between the platform 13 and the boat and greatly reduces the relative movement between these two structures.

Figure 8:
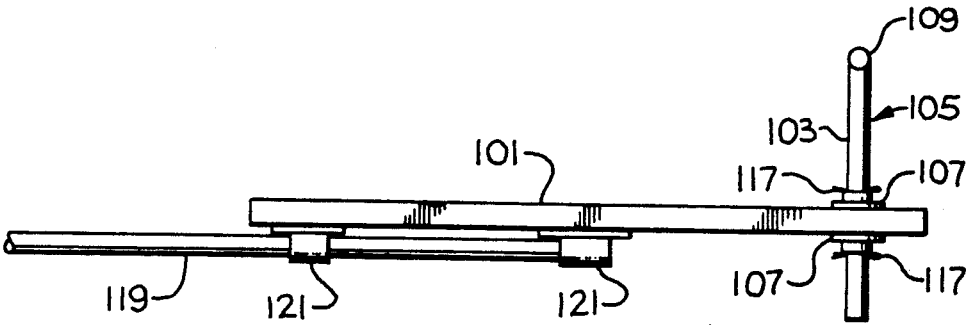
FIGS. 8 and 9 illustrate still a further embodiment of the invention utilizing a removable T-bracket.
Figure 9:
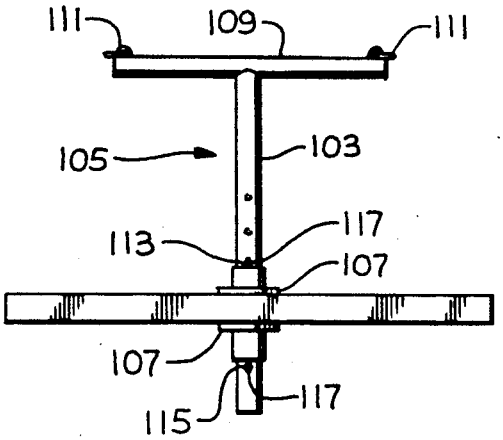

In accordance with a presently preferred embodiment of the invention, shown in FIGS. 8 and 9, the swim platform member is an elongated rectangular solid board 101 of wood or other strong lightweight material. Extending through a hole at one end of the board 101 is a vertical portion 103 of a T-bar member 105. In order to provide for a stable configuration, conventional ring flange members 107 are fastened to opposite sides of the board 101 coaxial with respect to the aforementioned hole. The T-bar 105 also includes a horizontal top portion 109, the extremities of which include holes 111 to accommodate attachment of the T-bar to an accompanying vessel by rope or other flexible material.

The vertical portion 103 of the T-bar may preferably include holes 113 and 115 therethrough spaced so that conventional cotter pins 117 extending through these holes hold the T-bar in place on the board, as shown in FIGS. 8 and 9.

Extending longitudinally from the other end of the board 101 is a tabular leverage arm member 119 that is held to the underside of the board 101 by conventional strap or bracket members 121 The members 121 may be mounted to the board by any conventional attachment means such as screws or bolts, for example. Not shown in these figures is a flotation member attached to the outer end of the elongated leverage arm member 119 that is similar to that shown in the previously described embodiments of the invention.

Figure 10:
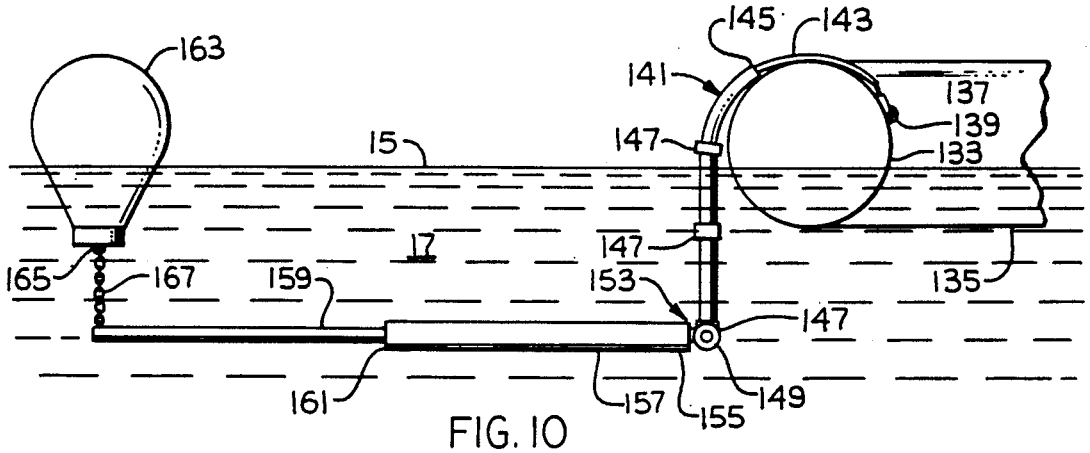
FIG. 10 is an illustration showing the swim platform of the invention attached to an inflatable boat.

With respect to FIG. 10, there is shown an inflatable boat 131 having tWo longitudinal pontoon side portions 133 and a floor member 135. Through the use of a snap shackle 137 or similar fastening structure coupled to a D-ring 139 mounted on an inner portion of one of the pontoon portions 133, a boarding ladder 141 is attached by a rope or strap 143 over the gunwale of the boat 131. It will be noted from this figure that generally only the inner side of the upper portion 145 of the ladder 141 is in contact with the boat's gunwale, and that the ladder includes transverse step members 147 and a pivot-holding bracket 149 attached at a lower portion 151 of the ladder.

Pivotally connected by a bracket and pin assembly 153 to the bracket 149 is an inner portion 155 of a platform member 157. As in the previously described embodiments of the present invention, an elongated leverage arm member 159 is attached to an outer portion 161 of the platform member, and a float structure 163 with a lower ring attachment 165 is connected by a flexible wire, rope, strap or cable 167 to the outer end 169 of the leverage arm 159.

Figure 11:
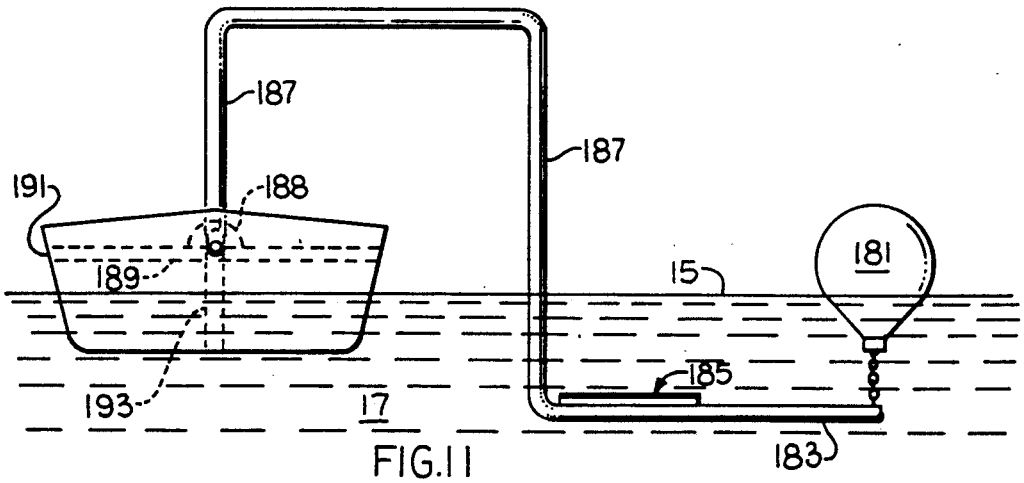
FIG. 11 shows yet another embodiment of the invention using a "stabilized pivot" mount.

There are occasions when a swimmer may have only a relatively unstable craft to which the invention can be attached. In order to best utilize the advantages of the invention in such a situation, an arrangement as shown in FIG. 11 may be incorporated. Here, the inventive combination of a float member 181, leverage arm 183, and sWim platform 185 is provided with generally invented U-shaped member or parallel members 187 attached at one end to the swim platform 185 (or made a part thereof) and pivotally coupled by means of a bracket assembly 188 to horizontal seat or cross brace 189 of a boat 191 having either a relatively shallow draft, or narrow beam, or both. Thus, any force transmitted from the swim platform itself or also including the weight of a swimmer on the platform will be concentrated along a line not tending to tip the boat, i.e., the center line. A hull-mounted vertical brace 193 may also be incorporated to support the seat 189 when the maximum load will be exerted.

Figure 12:
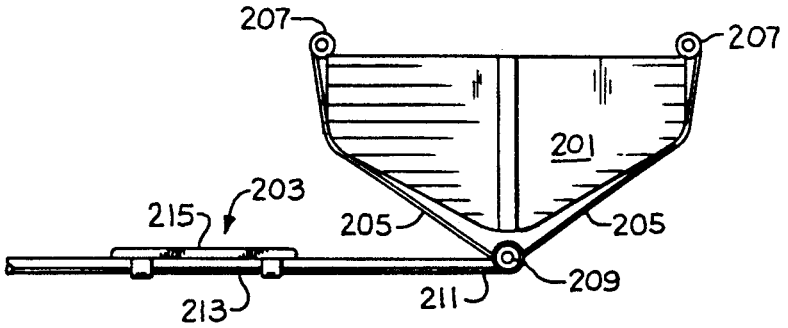
FIG. 12 is a simplified representation of another stabilized support for the invention.

Similarly, an unstable boat 201 (FIG. 12) may be used to support the invention 203 by utilizing an underslung strap or straps 205 attached at their upper ends to appropriate attachment points 207, and pivotally supporting at pivot 209 an inner portion 211 of a swim platform 213 fitted with an upper seat or cushion portion 215. Again, any load forces produced by the invention 203 will be applied along the longitudinal center line of the boat 201 and will not tend to cause the boat to tip.

Figure 13:
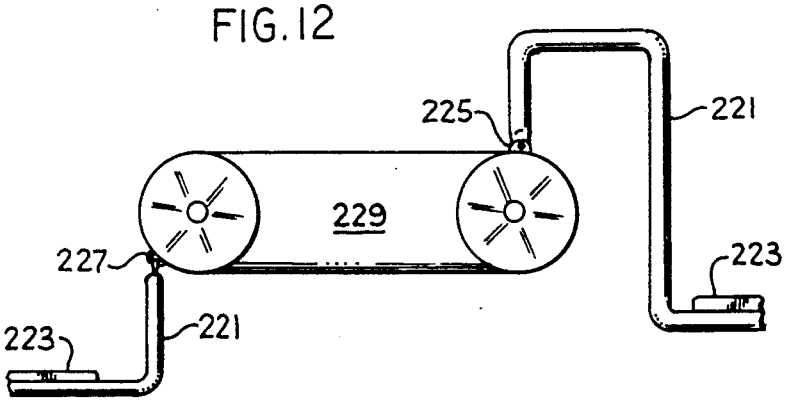
FIG. 13 is a simplified representation illustrating two additional embodiments used in conjunction with non-grid small water craft.

Unlike conventional rigid boats which tend to be laterally unstable if not of a deep displacement design and/or with a narrow beam, most inflatable craft having a pair of parallel longitudinal pontoon-like portions exhibit much more stability than a rigid boat of comparable beam dimensions. Accordingly, the invention may be utilized in a manner to take advantage of this advantageous characteristic by providing a support bracket 221 for the inventive swim step 223 pivotally attached either to a pontoon-mounted upper bracket 225 or an under water pivot bracket or ring 227 of inflatable boat 229, as shown in FIG. 13.

Figure 14:
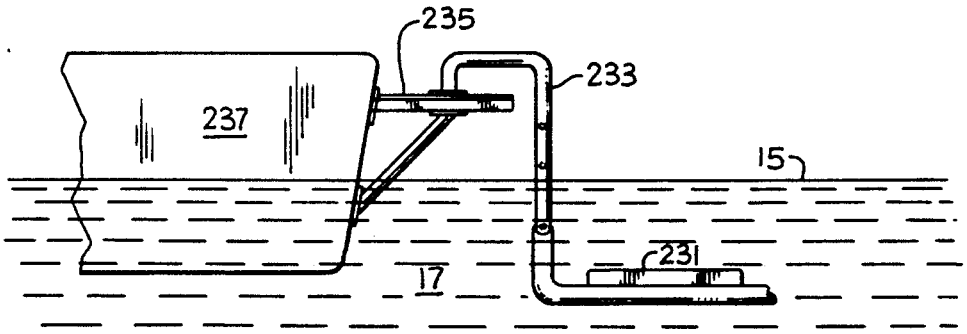
FIG. 14 illustrates two further embodiments of the invention that may be utilized with a rigid small boat.

FIG. 14 illustrates the use of a T-bar or L-bracket 231 pivotally attached to a conventional short ladder 233 extending from a stern-mounted swim step 235 of boat 237.

Figure 15:
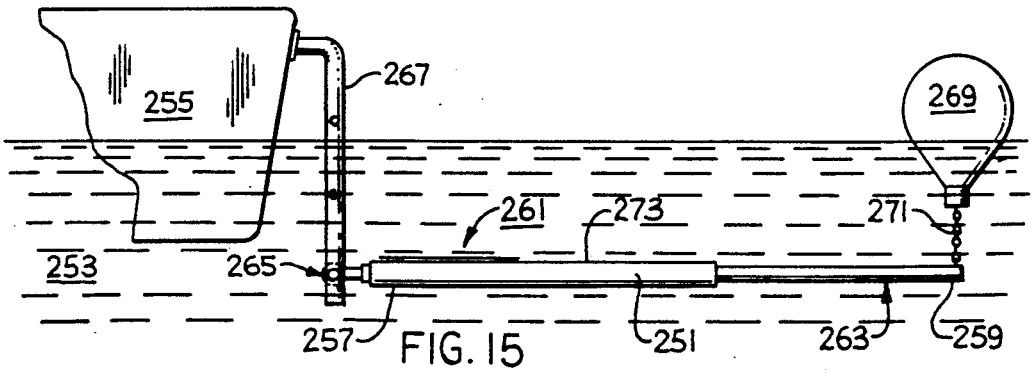
FIG. 15 is a side view of an embodiment of the present invention coupled to a rigid boat's stern swim step.

In accordance with still a further embodiment of the invention, as illustrated in FIG. 15, a swim platform 251 is designed to facilitate a swimmer's egress from a body of water 253 onto a structure such as a boat 255 supporting the platform 251. The swim platform has an inner end 257 and an outer end 259, and also has a weight bearing portion 261 adjacent the inner end 257, and an elongated lever arm portion 263 extending outwardly from the weight bearing portion 261.

The inner end 257 of the platform 251 is pivotally coupled by a pivot pin arrangement 265 to a support structure such as a boat ladder 267, while a buoyancy structure or float 269 is attached by a tether 271 to the outer end 259 of the lever arm portion 263, spaced from the weight bearing portion 261, in order to support the platform structure when the weight bearing portion of the platform structure is supporting the weight of a swimmer. A non-slip or cushion material 273 may also be provided on the upper surface of the weight bearing portion 261 for the comfort and safety of the swimmer.

In operation of these embodiments, the submersed platform functions as a zone of transition. By remaining submersed and stable both axially and longitudinally, it allows a swimmer or diver to easily move from a horizontal or swimming body position to a vertical or boarding body position. This transition is simplified by enabling the swimmer to use both the buoyancy of the water along with the solid support of the platform. The system of the invention approximates the shallow end of a swimming pool.

The invention thus greatly speeds the boarding process. It allows a safe haven where swimmers and divers can enter with no initial effort and use the platform to regain their strength and remove cumbersome equipment prior to taking on the task of boarding. The device is particularly useful in lifeguard and rescue operations.

From the foregoing it should be evident that there has herein been described a new and improved submersible swim platform designed to increase the safety and ease of exiting the water to board a boat. The invention is capable of attaching to and functioning with existing ladder systems. It may also replace the ladder for use with inflatable boats and other boats with low freeboard.

Although the invention has been described in detail with respect to presently preferred embodiments of the invention, it should be understood that the invention may be practiced using similar functioning but different elements, under the scope of the appended claims.

What is claimed is:

1. A swim platform to facilitate a swimmer's egress from a body of water onto a platform supporting structure, comprising:

a swim platform structure having an inner end and an outer end, and disposed horizontally in the body of water at a desired depth;

an elongated lever arm member having a first end and an opposite second end, and attached at said first end to said outer end of said platform structure;

pivotal means attached to said inner end of said platform structure and to the platform supporting structure for pivotal support of said platform structure in the body of water by the supporting structure; and buoyancy means attached to said second end of said lever arm member for supporting said platform structure in a horizontal position in the body of water before and when said platform structure is supporting the weight of a swimmer.

2. The swim platform according to claim 1, wherein said elongated lever arm member of said swim platform structure is narrow relative to said platform structure.

3. The swim platform according to claim 1, wherein said buoyancy means includes a solid float structure.

4. The swim platform according to claim 1, wherein said buoyancy means includes a hollow float structure.

5. The swim platform according to claim 4, wherein said hollow float structure is an inflatable structure.

6. The swim platform according to claim 1, wherein said elongated lever arm member is an elongated rod.

7. The swim platform according to claim 6, wherein said elongated rod is a solid rod.

8. The swim platform according to claim 6, wherein said elongated rod is a hollow tube.

9. The swim platform according to claim 1, wherein said buoyancy means includes a float structure and flexible attachment means coupling said float structure to said lever arm member.

10. The swim platform according to claim 9, wherein said attachment means is attached to the end of said lever arm member adjacent said second end.

11. The swim platform according to claim 9, wherein said attachment means includes a chain tether member.

12. A boat boarding device, comprising:

a mounting member for attachment to a boat floating on a body of water;

a boarding platform member having an inner end and an outer end, and positioned horizontally in the body of water at a desied depth;

pivot means coupled to said mounting member and said platform member for pivotally attaching said inner end of said platform member to said mounting member;

a lever arm member having an inner end and an outer end, said inner end of said lever arm memer being mounted to said platform member and extending outwardly beyond said outer end of said platform member;

a buoyancy structure; and means for attaching said buoyancy structure to said outer end of said lever arm member for buoyant support of said lever arm and said horizontal platform member.

* * * * *